US009333557B2

(12) United States Patent
Nitzl et al.

(10) Patent No.: US 9,333,557 B2
(45) Date of Patent: May 10, 2016

(54) NOZZLE FOR GUIDING A METAL MELT

(75) Inventors: Gerald Nitzl, Baden (AT); Yong Tang, Leoben (AT); Arno Stranimaier, Trieben (AT)

(73) Assignee: REFRACTORY INTELLECTUAL PROPERTY GMBH & Co. KG, Vienna (AT)

( * ) Notice: Subject to any disclaimer, the term of this patent is extended or adjusted under 35 U.S.C. 154(b) by 232 days.

(21) Appl. No.: 14/123,717

(22) PCT Filed: Jun. 27, 2012

(86) PCT No.: PCT/EP2012/062485
§ 371 (c)(1),
(2), (4) Date: Dec. 3, 2013

(87) PCT Pub. No.: WO2013/004571
PCT Pub. Date: Jan. 10, 2013

(65) Prior Publication Data

US 2014/0103079 A1 Apr. 17, 2014

(30) Foreign Application Priority Data

Jul. 6, 2011 (EP) ..... 11172908

(51) Int. Cl.
*B22D 41/50* (2006.01)

(52) U.S. Cl.
CPC ..... *B22D 41/50* (2013.01)

(58) Field of Classification Search
CPC ..... B22D 41/51; B22D 41/50
USPC ..... 222/591, 606; 164/488, 437
See application file for complete search history.

(56) References Cited

U.S. PATENT DOCUMENTS

| | | | | |
|---|---|---|---|---|
| 5,961,874 | A | 10/1999 | Hasebe et al. | |
| 6,165,409 | A | 12/2000 | Dubois et al. | |
| 6,464,154 | B1 * | 10/2002 | Heaslip | B22D 41/50 222/603 |
| 6,467,704 | B2 * | 10/2002 | Sahai | B22D 41/50 239/553.5 |
| 7,363,959 | B2 * | 4/2008 | Hanna | B22D 41/50 164/137 |
| 7,757,747 | B2 * | 7/2010 | McIntosh | B22D 41/50 164/137 |

FOREIGN PATENT DOCUMENTS

| | | | |
|---|---|---|---|
| DE | 10240491 | A1 | 1/2004 |
| EP | 0482423 | A1 | 4/1992 |
| EP | 0519271 | A1 | 12/1992 |
| EP | 0946321 | B1 | 5/2001 |
| EP | 2226141 | A2 | 9/2010 |
| WO | 2007138260 | A2 | 12/2007 |

* cited by examiner

*Primary Examiner* — Scott Kastler
*Assistant Examiner* — Michael Aboagye
(74) *Attorney, Agent, or Firm* — Walker & Jocke

(57) ABSTRACT

The present invention relates to a nozzle for guiding a metal melt from a first apparatus to a second apparatus, in particular it relates to a submerged entry nozzle for guiding a stream of a metal melt (steel melt) from a metallurgical melting vessel (like a tundish) into a mold (like an ingot), both of which may also be called "reservoir".

11 Claims, 3 Drawing Sheets

NOZZLE FOR GUIDING A METAL MELT

CROSS-REFERENCES TO RELATED APPLICATIONS

This application is a national stage entry of PCT/EP2012/062485, which claims benefit of foreign priority document EP 11172908.3 filed on Jul. 6, 2011.

BACKGROUND

The present invention relates to a nozzle for guiding a metal melt from a first to a second means, in particular it relates to a submerged entry nozzle for guiding a stream of a metal melt (steel melt) from a metallurgical melting vessel (like a tundish) into a mould (like an ingot), both of which may also be called "reservoir".

Such a submerged entry nozzle (hereinafter called also SEN) is used in the continuous casting of steel slabs. A SEN typically comprises a refractory ceramic tube-like body with an inlet opening at its first end (the upper end in its mounting position) and a conduit (an internal channel), running from said inlet opening through said ceramic tube in an axial direction of the nozzle (tube) to its second end (the lower end in its mounting position), which second end provides a body stop of the channel in its longitudinal extension and at least two lateral outlet openings of said channel through which the metal melt enters into the mould.

In other words: The molten metal stream, coming from a tundish or similar vessel, enters the inlet opening, further runs vertically and downwardly through said conduit (through the intermediate or middle portion of the nozzle between upper and lower end) from said inlet opening towards said outlet opening(s), being deflected on its way to said outlet opening (s) and leaves the nozzle more or less perpendicular to its axial extension through these outlet openings before entering the associated mould.

This is true as well with respect to the SEN as disclosed in WO 2007/138260 A2 with the proviso that flow dividers, arranged at the lower (outlet) end of the nozzle, are responsible for dividing the metal stream in numerous partial streams before leaving the nozzle.

This general design concept is further realized by EP 0946321 B1, the nozzle of which being provided with a 2 part flow divider in its exit zone (=lower end of nozzle) to minimize the appearance of cracks.

The known design may lead to turbulences in the metal bath in the associated mould and/or to turbulences in any slag layer and/or any mould (masking) powder on top of the metal bath. These effects can reduce the steel quality and the quality of the cast product respectively. The know design is also responsible for a limited flow capacity (flow rate).

It is an object of the invention to provide a nozzle of the type mentioned which provides a high flow-rate without causing undesired lateral turbulences by the metal stream leaving the nozzle and entering into the metal bath in the associated aggregate (for example a mould).

SUMMARY

The invention is based on various technical aspects. The probably most important is to design the nozzle such that a central stream of metal melt may flow through the nozzle from the inlet opening to the outlet opening in a substantially continuous axial direction. In other words: The nozzle design allows at least part of the metal stream to flow through the nozzle without being deflected, bypassed, turned or the like.

This central stream follows the longitudinal axial direction of the tube-like refractory body with its inner conduit all over the nozzle length.

Typically this central stream is coaxial to the central longitudinal axis of the nozzle, being an axis in a substantially vertical orientation during use of the nozzle.

This central stream of metal melt allows a remarkable increase of the flow-capacity of the nozzle. As this central melt stream follows a substantially vertical, downwardly oriented direction turbulences around the lower nozzle section and/or around the corresponding outlet section are avoided as far as possible.

Besides this important design feature the nozzle is characterized by at least two baffles, projecting from the inner wall of the refractory body (being the circumferential wall of the conduit). From the aforesaid it become apparent that the said baffles do not extend across the full width/diameter of the conduit but that these baffles are designed and arranged in such a way as to leave free a space between them so that the central metal melt stream may pass therethrough along the middle section of the nozzle between inlet and outlet openings.

Nevertheless the baffles mentioned are modifying the relevant cross-section of the conduit and/or provide means to deflect the remaining metal stream on its way to the lower end and the outlet openings of the nozzle. Insofar the one metal stream entering the nozzle via said inlet opening may be divided by these baffles into several partial streams. Contrary to prior art nozzles as mentioned above all these partial streams are fluidly connected with each other and/or the central stream. In other words: The partial streams (side streams) and the central metal melt stream are arranged in one common space defined by the circumferential wall of the conduit and the baffles respectively.

In its most general embodiment the invention is directed to a nozzle for guiding a metal melt from a first to a second means, comprising

- a refractory, tube-like body with
- an inlet opening at its first end
- an outlet opening at its second end
- a conduit, elongate along a central longitudinal axis, which is oriented vertically during use, limited by an inner wall of the refractory, tube-like body and extending from said inlet opening to said outlet opening, and
- baffles, projecting from said inner wall into the conduit, wherein
- the geometry of the conduit and the baffles is such that a continuous flow passage (area) around the central longitudinal axis being provided for the metal melt between the inlet opening and one single outlet opening.

The technical and functional features mentioned are true as well with respect to an embodiment wherein the tube like body comprises:

- adjacent to the inlet opening: an upper section of substantially circular cross-section,
- adjacent to the outlet opening: a lower section, flared outwardly in one first plane and flattened in a second plane substantially perpendicular to the first plane,
- a middle section between said upper section and said lower section, wherein the middle section provides a design transition from the circular design of the upper section to the flattened design of the lower section.

While the general circular outer design at the upper and a flattened design at the lower end correspond widely with that of the nozzle known from WO 2007/138260 A2 the decisive difference between both designs is that the new nozzle provides said central axial flow stream along the whole length of the nozzle and thus for a considerable volume of the metal melt to pass the nozzle without any deflections. In other words: The continuous free central interspace (extending between inlet and outlet opening of the nozzle) enables to cut the nozzle along a plane in the longitudinal direction of the nozzle into two pieces, for example two mirror inverted pieces, without contacting and/or cutting any baffle.

In the embodiment following claim 2 the central axial stream may extend over the full length of the lower nozzle opening while the baffles mentioned are responsible for at least 2 auxiliary metal streams, one on each side of the central stream, which baffles have the function of guiding means for directing the respective metal stream to the respective lateral section of the one outlet opening.

These laterally escaping metal streams are of lower velocity compared with those according to prior art nozzles and thus are causing less turbulences in the metal bath, any slag layer and/or masking powder in and onto the metal bath in the corresponding vessel.

Compared with the nozzle of EP0946321B1 the main differences of the new design are: baffles are arranged in the middle section of the nozzle between upper and lower end, they may further extend into lower and/or upper end, always providing a free space between them for the free axial flow of the melt. The baffles may extend ≥50%, ≥60%, ≥70% or even ≥80% of the total axial length of the nozzle.

The invention further provides one or more of the following embodiments:

A nozzle, wherein the design transition proceeds substantially continuously between the upper section and the lower section. In other words: a smooth, soft changeover between the two sections is wanted, avoiding any sharp edges, ridges, grooves etc. This is true as well for the inner and outer design of the nozzle.

A nozzle with at least one first pair of baffles, protruding from opposing sections of the inner wall of the refractory body and leaving a passage between them through which the central longitudinal axis extends. It is not obligatory to arrange the baffles in a mirror-inverted fashion, although this design makes the total metal flow more homogeneous. The baffles may also be arranged offset with respect to the axial extension of the nozzle and/or more than 2 baffles may protrude from the inner wall of the body at one axial position along the nozzle length.

At least one or each baffle (ridge) may having the shape of an inverted V (in a front view), optionally with one or more of the following features: a flat (even planar, if wanted) main area facing a corresponding flat main area of the other baffle, upper and/or lower borders substantially following the design of the corresponding section of the inner wall of the refractory body vis-à-vis said border.

Based on the generic design of a nozzle like an SEN it derives from an arrangement of the baffles according to an inverted V that the distance between the V-legs increases toward the second end of the nozzle, being the outlet end of the nozzle or its conduit respectively. With a nozzle design having two lateral outlet openings this leads to a run of the V-legs providing an angle between 15° and 45° between a first imaginary line intersecting the two vertical extremities of one leg and a second imaginary line parallel to the longitudinal axis of the nozzle and intersecting the first imaginary line (as shown in the accompanying drawing). The maximum angle may be set as well at 30° or 25° or 22°. This may be realized in an analogous manner with discrete baffle bars.

A second and/or third pair of baffles may be provided, each of substantially same general design as the first pair of baffles, but arranged at a distance to said first pair of baffles.

According to one embodiment the distance between opposing baffles of each pair of baffles is constant or decreases toward the outlet opening of the nozzle.

A nozzle as mentioned with at least one first pair of baffles being arranged, at least partially, in the lower section of the nozzle and/or A nozzle with at least one first pair of baffles being arranged, at least partially, in the middle section of the nozzle.

At least one baffle or a first pair of baffles may terminate in the outlet opening, although it is possible as well to arrange the baffle(s) in such a way that it/they end(s) at a distance before the corresponding outlet section of the outlet opening.

The nozzle may have at least one of the following dimensions:

- a distance between opposed baffles of between 5 and 15 mm
- a baffle height, perpendicular to the central longitudinal axis (A) of 5-20 mm
- an inlet opening with an inner diameter of between 40 and 120 mm
- an outlet opening with a length of between 100 and 400 mm and a width of between 5 and 40 mm.
- an outlet opening with a length of at least twice the diameter of the inlet opening and/or a width of at most half the diameter of the inlet opening. This corresponds to a general design of a so called thin-slab SEN (german: "Breitmaul ETA")
- the outlet opening is defined by a central axial outlet section and two lateral outlet sections, extending towards the inlet opening.

Referring to the "inverted V" design of a baffle one further embodiment provides for a "V with curved legs". This curvature may be parallel to a corresponding curvature of the inner wall of the refractory body (i.e. the curvature of the conduit wall). Another embodiment provides a design according to which any distance between the conduit wall and the corresponding border surface of the baffle becomes smaller in the direction towards the outlet opening.

The nozzle can be made of any conventional refractory material (like a material based on MgO, $Al_2O_3$, $ZrO_2$, C) and may be manufactured by any conventional process (i.e. isostatic pressing).

Further features of the nozzle are described in the subclaims and the other application documents, including the drawing and description of corresponding embodiments which may include features of general validity, independent from the specific example.

Unless otherwise disclosed the term "substantially" characterizes the corresponding feature as achieved under technical aspects. For example: "Substantially vertical orientation of the nozzle during use" does not necessarily mean an exact vertical orientation under mathematic aspects but the typical technical position.

BRIEF DESCRIPTION OF THE DRAWINGS

The drawing shows, in a highly schematic way, in

DETAILED DESCRIPTION

All Figures show a so-called submerged entry nozzle (SEN), made of an MgO based batch, isostatically pressed and fired according to conventional techniques.

The SEN shows a tube-like refractory body 10 with one single inlet opening 12 of substantially circular cross section at its first end (the upper end in the use position as shown) and one single outlet opening 14 of substantially rectangular/oval cross section at its second end (the lower end in the use position). Inlet opening 12 and outlet opening 14 are bridged by a conduit 16, elongate along a central longitudinal axis (A) of the body 10, which axis is oriented substantially vertical during use of the nozzle. Conduit 16 is defined by an inner wall 10*i* of the refractory tube-like body 10.

Figure 2:
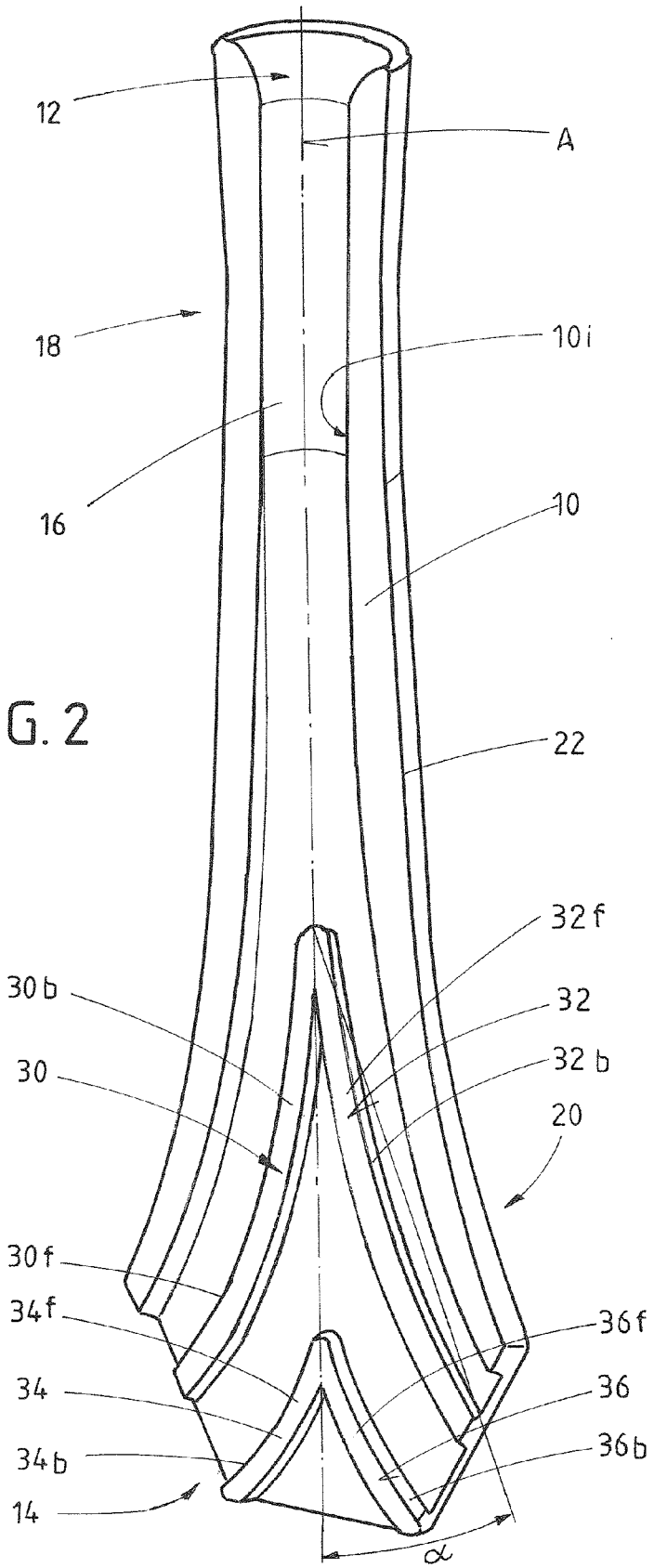
FIG. 2: a three-dimensional view onto the inner contour of the nozzle according to FIGS. 1*a* and 1*b*

Corresponding to the general design of upper and lower section 18,20, inlet opening 12 and outlet opening 14 of said nozzle, conduit 16 varies its cross section from circular to a geometry similar a flat oval or a thin rectangle with rounded end portions. This change is mostly realized in the middle section 22 (FIG. 2).

Figure 1A:
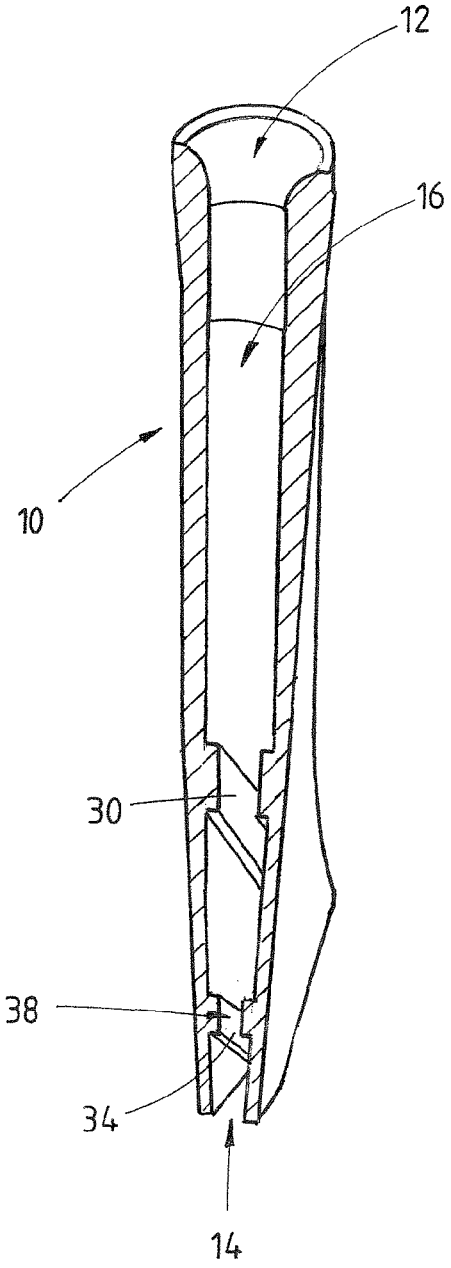
FIGS. 1*a* and 1*b*: three-dimensional views onto a nozzle according to the invention, partly cut off
Figure 1B:
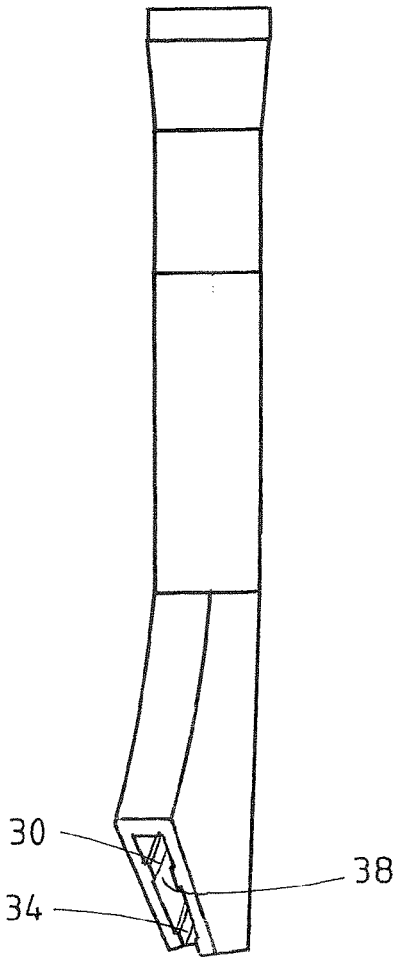

The general design may be described as follows: tube like body 10 comprises, adjacent to the inlet opening 12, an upper section 18 of substantially circular cross-section, adjacent to the outlet opening 14, a lower section 20, flared outwardly in one first plane (the drawing plane) and flattened in a second plane (vertical to the drawing plane), substantially perpendicular to the first plane, a middle section 22 between said upper section 18 and said lower section 20, wherein the middle section 22 provides a design transition from the circular design of the upper section 18 to the flattened design of the lower section 20. This design transition proceeds substantially continuously between upper and lower section 18,20, as may be seem from FIGS. 1*a*, 1*b* and 2.

The lower section 20 therefore has a length about 8 times its width. The same being true for the cross section of the corresponding outlet opening 14.

From each of opposing sections of the inner wall 10*i* in the middle section 22 and the lower section 20 baffles 30, 32, 34, 36 protrude into the conduit 16, thereby forming a gap 38 between corresponding flat main areas (front surfaces) 30*f*, 32*f*, 34*f*, 36*f*. Baffles 30,32 and 34,36 respectively are linked together, thus each providing the shape of an inverted V with slightly curved outer borders 30*b*, 32*b*, 34*b*, 36*b* and inner borders. Theses borders follow the corresponding shape of the inner wall 10*i* opposite the respective border.

The two pairs of baffles 30,32; 34,36 on each side of the conduit 16 (FIG. 2 only shows one side) are arranged offset along the central longitudinal axis A of the nozzle and ending in the corresponding common outlet opening 14.

The angle α between the central longitudinal axis A and a line intersecting the two vertical extremities of one leg 32 is about 17° (a typical range being 15°-25°), i.e. die V includes an angle of 2×17°=34°. This is true as well with respect to the lower baffle provided by legs 34,36.

Because of the distance (gap 38) of corresponding baffles 30, 30; 32, 32; 34, 34; 36, 36 it becomes clear that the nozzle provides a central passage around the central longitudinal axis A which runs continuously and substantially straight from the inlet opening 12 to the outlet opening 14. Correspondingly the nozzle provides a central passage for the metal melt, along which the melt is fed in a more or less linear way (arrow D in FIG. 3) to and through the outlet opening 14 and thus in a downwardly oriented vertical orientation into a corresponding mould 40 (FIG. 3).

Figure 3:
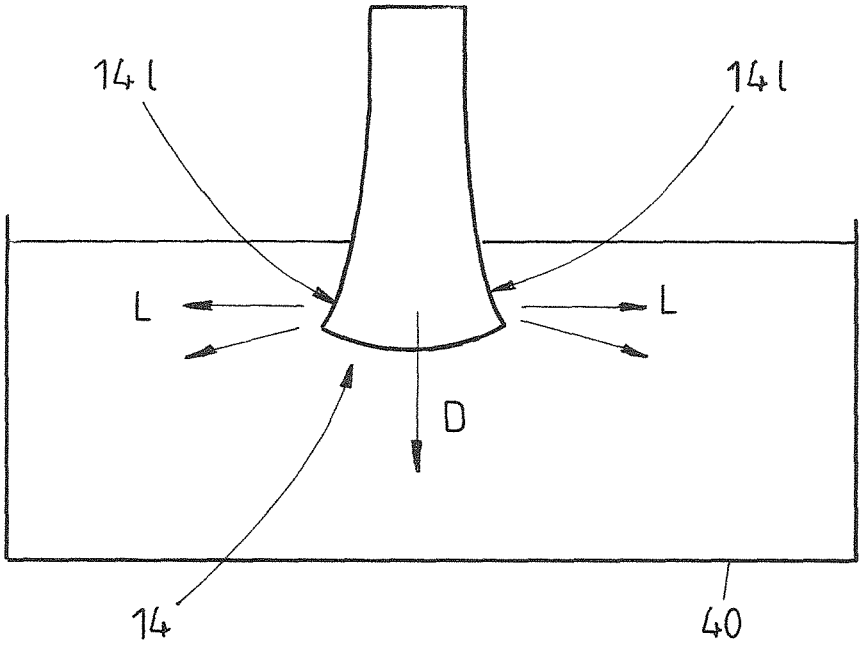
FIG. 3: an outflow area of the nozzle and corresponding flow directions of the melt.

The baffles 30, 32, 34, 36, arranged adjacent on both sides of the central passage, cause the melt to follow their respective borderline and thus being directed to lateral sections 141 of the common outlet opening 14 and leaving the outlet opening 14 substantially laterally (arrows L in FIG. 3).

It is important to strengthen that although the metal stream takes different directions while leaving the nozzle there is only one outlet opening 14 and all these central and lateral metal streams are in fluidic contact with each other.

FIG. 3 shows three main directions of the outflowing metal stream. One, the central stream D, in extension of axis A vertically downwardly and the other two laterally (L) at opposing sides of the outlet opening 14.

By this design the flow through rate may be increased and turbulences in the metal bath of the associated vessel (mould 40) are reduced.

What is claimed is:

1. A nozzle for guiding a metal melt from a first apparatus to a second apparatus, comprising:

a) a refractory, tube-like body (10), wherein the body (10) includes:

an inlet opening (12) at a first end (18) of the body (10);

a single outlet opening (14) at a second end (20) of the body (10); and a conduit (16), wherein the conduit (16) is elongated along a central longitudinal axis (A) which is oriented vertically during use, wherein the conduit (16) is limited by an inner wall (10*i*) of the refractory, tube-like body and extends from the inlet opening (12) to the outlet opening (14); and b) a plurality of baffles (30, 32, 34, 36), wherein the baffles (30, 32, 34, 36) project from the inner wall (10*i*) into the conduit (16), wherein geometry of the conduit (16) and the baffles (30, 32, 34, 36) is such that a flow passage around the central longitudinal axis (A) is provided for the metal melt continuously between the inlet opening (12) and the outlet opening (14), wherein at least one first pair of the baffles (30, 32; 34, 36) protrudes from a pair of opposing sections of the inner wall (10*i*) of the refractory body (10) and a passage (38) extends between the baffles of the at least one first pair of baffles (30, 32; 34, 36) through which the central longitudinal axis (A) extends, wherein in a front view the at least one first pair of baffles (30, 32; 34, 36) each has an inverted V shape.

2. The nozzle according to claim 1, wherein the tube-like body (10) comprises:

a) an upper section (18) of substantially circular cross-section adjacent to the inlet opening (12);

b) a lower section (20), wherein the lower section (20) is located adjacent to the outlet opening (14), wherein relative to the circular cross section of the upper section (18) the lower section (20) is flared outwardly in one first plane and flattened in a second plane substantially perpendicular to the first plane; and c) a middle section (22) between the upper section (18) and the lower section (20), wherein the middle section (22)

provides a transition from the circular cross-section of the upper section (18) to the lower section (20).

3. The nozzle according to claim 2, wherein the transition proceeds substantially continuously between the upper section (18) and the lower section (20).

4. The nozzle according to claim 1 wherein each of the pairs of baffles (30, 32; 34, 36) in the front view has an inverted V shape and a flat main area so that the flat area of opposing baffles are facing each other, as well as upper and lower borders (30*b*, 32*b*, 34*b*, 36*b*) substantially following the design of the corresponding section of the inner wall (10*i*) of the refractory body vis-à-vis said border (30*b*, 32*b*, 34*b*, 36*b*).

5. The nozzle according to claim 4, wherein the second pair of baffles (34, 36) is substantially of a same configuration as the first pair of baffles (30, 32) but arranged at a distance to the first pair of baffles (30, 32).

6. The nozzle according to claim 2 with at least one first pair of baffles (34, 36) extends, at least partially, in the lower section of the tube-like body of the nozzle.

7. The nozzle according to claim 2, wherein at least one first pair of baffles (30, 32) extends, at least partially, in the middle section of the tube-like body of the nozzle.

8. The nozzle according to claim 4, wherein the first pair of baffles (30, 32) terminates in the outlet opening (14).

9. The nozzle according to claim 4 having at least one of the following dimensions:

a) a distance between opposed baffles (30, 30; 32, 32; 34, 34; 36, 36) of between 5 and 15 mm;

b) a baffle height, perpendicular to the central longitudinal axis (A) of from 5-20 mm;

c) the inlet opening (12) having an inner diameter between 40 and 120 mm; and d) the outlet opening (14) having a length between 100 and 400 mm and a width between 5 and 40 mm.

10. The nozzle according to claim 1, wherein the outlet opening (14) has a length of at least twice a diameter of the inlet opening (12), or a width of at most half the diameter of the inlet opening (12), or both a length of at least twice the diameter of the inlet opening (12) and a width of at most half the diameter of the inlet opening (12).

11. The nozzle according to claim 1, wherein the outlet opening (14) is defined by a central axial outlet section and two lateral outlet sections, extending from the central axis outlet section towards the inlet opening (12).

* * * * *